United States Patent [19]

Bozine

[11] Patent Number: 4,607,669

[45] Date of Patent: Aug. 26, 1986

[54] REPAIR TOOL FOR DEFECTIVE WRAPPED WIRE ELECTRICAL CONNECTIONS

[75] Inventor: Nicholas Bozine, Philadelphia, Pa.

[73] Assignee: Burroughs Corporation, Detroit, Mich.

[21] Appl. No.: 634,701

[22] Filed: Jul. 26, 1984

[51] Int. Cl.[4] ..... B21F 15/04

[52] U.S. Cl. ..... 140/124; 140/104

[58] Field of Search ..... 140/124, 123, 122, 119, 140/93 A, 117, 118, 102.5, 104; 242/7.17, 7.18; D8/44, 14; 29/229, 226, 225, 270

[56] References Cited

U.S. PATENT DOCUMENTS

| | | | |
|---|---|---|---|
| 2,546,489 | 3/1951 | Wright | 140/124 |
| 2,809,676 | 10/1957 | Kirkwood | 140/102.5 |
| 2,884,210 | 4/1959 | Strauss | 140/117 |
| 3,229,727 | 1/1966 | Kenlon | 140/123 |

FOREIGN PATENT DOCUMENTS

| | | | |
|---|---|---|---|
| 1398823 | 6/1975 | United Kingdom | 140/124 |

*Primary Examiner*—Lowell A. Larson

*Attorney, Agent, or Firm*—Francis A. Varallo; Kevin R. Peterson

[57] ABSTRACT

The present disclosure describes a tool for correcting an otherwise rejectable pigtail in the last turn of a wrapped wire connection—the latter turn being oriented orthogonally to the longitudinal axis of the wrapping post but being displaced therefrom by a distance in excess of that permitted by quality control standards. The present tool is adapted to be inserted over the post and includes a cylindrical finger-like projection. Rotation of the tool by an operator causes the projection to engage the pigtail and to wipe it down toward the surface of the wiring post, thereby bringing it within acceptable tolerances.

4 Claims, 4 Drawing Figures

REPAIR TOOL FOR DEFECTIVE WRAPPED WIRE ELECTRICAL CONNECTIONS

BACKGROUND OF THE INVENTION

The manufacture of electrical equipment, such as that employed in electronic data processing, involves myriad electrical wiring connections. To effect the latter, wire wrapping techniques, capable of automatic and semi-automatic implementation, have achieved considerable prominence as an alternative to well known solder methods.

It has been observed that an undesirable pigtail is sometimes formed in the last turn of the wrapped wire connection. The pigtail results from a substantial lateral displacement of the last turn from the surface of the wrapping post. Such a condition often results from premature release of the wrapping bit from the post. In some semiautomatic operations, operator error may be at fault, and in automatic operations, any condition resulting for example, in a reduction of the rotational speed of the wire wrap bit during a fixed wrapping period, may be responsible. In either case, quality control standards dictate that if the last turn extends more than a prescribed distance, such as, that equivalent to one wire diameter, from the post, the wrap connection is to be rejected. The principal reason for the latter is that the protruding wire is susceptible to being caught and pulled during routine handling or servicing of the associated wiring board. If this should occur, the gas-tight wrap could be loosened, thereby compromising the electrical integrity of the connection. In the absence of the present invention, the pigtail defect has been remedied by completely removing the wrap and rewiring the connection. Attempts to grasp the pigtail with a tweezers or long-nose pliers and to urge it toward the post have proved unsatisfactory. Since the formation of pigtails may be repetitive in a particular wiring operation, it is not unusual to find a large number of such defects on a single interconnection medium, such as a backplane wiring board. Accordingly, virtually the entire board must be revised. Rework of this type is tedious, time consuming and costly.

What is desirable is a means of permitting the wrapping operator, and if necessary, the quality control inspector to correct such pigtails without such rework. The present invention provides such a means in the form of a simple, inexpensive and easily used hand tool.

SUMMARY OF THE INVENTION

In accordance with the present invention, there is provided a repair tool for correcting the lateral displacement of the last turn of a wrapped wire connection from its wrapping post.

More specifically, the present tool is comprised of an elongated tubular body preferably mounted in a handle or otherwise suitably supported, as in a pin vise. A cylindrical member is immovably affixed to the body and lies within a longitudinal slot formed in the wall structure of the latter and projects beyond the forward extremity thereof. Preferably, a portion of the surface of the cylindrical member disposed within the last mentioned slot is substantially coincident with the surface defined by the diameter of the body bore.

In utilizing the present repair tool to correct a pigtail defect, the operator places the tubular body over the wiring post. The diameter of the body bore is chosen to accommodate the maximum dimension of the post itself but not including the wraps of wire thereon. Accordingly, the forward extremity of the body rests upon the wire. The operator then rotates the tool body about the longitudinal axis of the wiring post in the same direction as the wraps were formed. The projecting portion of the tubular member contacts the pigtail and with a wiping action, moves the latter into close proximity with the surface of the post.

The repair operation, which takes only a few seconds for each pigtail, does not mar the surface of the wire turn, nor does it affect the integrity of the remaining wire wraps. Other features and advantages of the present invention will become apparent in the detailed description thereof which follows.

DESCRIPTION OF THE PREFERRED EMBODIMENT

Figure 1:
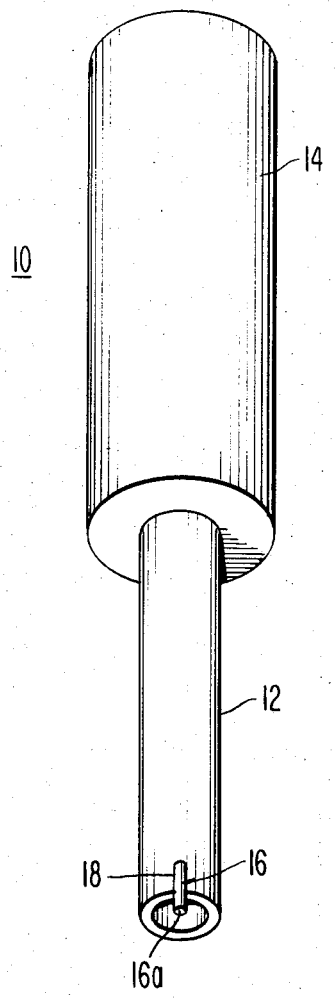
FIG. 1 is a pictorial illustration of the repair tool of the present invention.

With reference to FIG. 1, there is illustrated an actual operative embodiment of the repair tool 10 of the present invention. The latter is comprised of an elongated tubular body 12 supported in a handle 14. A cylindrical member 16 is immovably affixed to the body 12 and provides a finger-like projection **16*a*** which extends beyond the forward body extremity.

Figure 2:
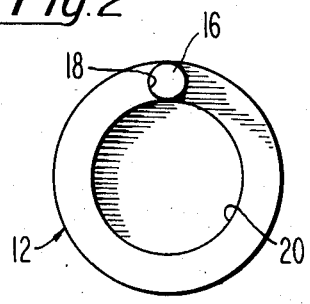
FIG. 2 is an end view of the forward extremity of the tool depicted in FIG. 1.

As seen in the end view of FIG. 2, the cylindrical member 16 may have an outside diameter substantially equal to the wall thickness of body 12. Accordingly, the cylindrical member 16 may be disposed in a slot 18 formed in the body wall structure. A portion of the surface of the member 16 lies on the circumference of the bore 20 within body 12.

Figure 3:
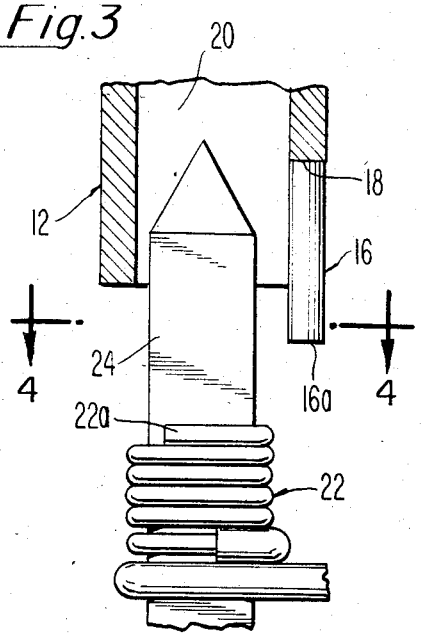
FIG. 3 depicts the disposition of the tool over the wiring post in preparation for the correction of a pigtail defect.
Figure 4:
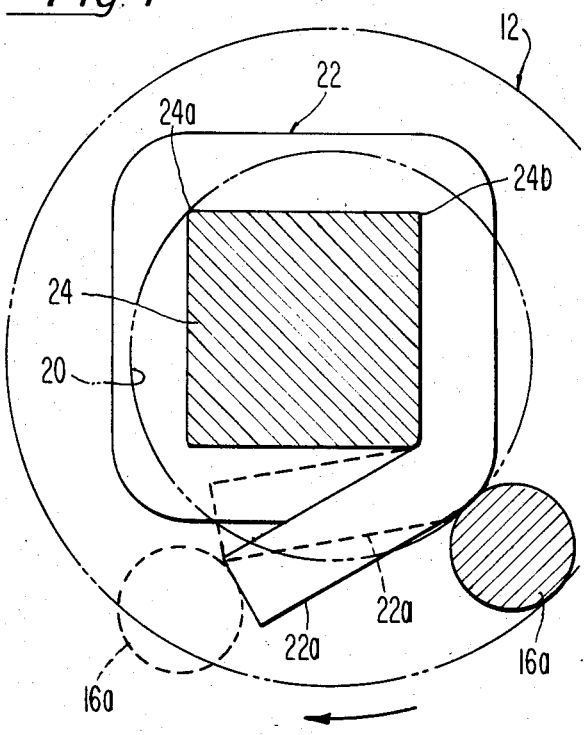
FIG. 4 is a section view taken along the lines 4—4 of FIG. 3 and illustrating the operation of the tool in wiping down a pigtail toward the surface of the wiring post.

The operation of the tool 10 is apparent from a consideration of FIGS. 3 and 4. Thus, FIG. 3 illustrates a wire 22 having a plurality of turns wrapped upon a wiring post 24 of rectangular cross section. The last or uppermost turn of the wire 22, as also seen in FIG. 4, appears as a pigtail **22*a*, in that it is displaced from its desired position in close proximity to post 24** and has a protruding extremity.

The operator places the body 12 of the tool 10 over the wiring post 24—the bore 20 of the former being chosen to accommodate the maximum dimension of the latter. The forward extremity of body 12 rests upon the wire 22, and as seen in FIG. 4, the finger-like projection **16*a* lies on the outside of the pigtail 22*a*. The respective longitudinal center lines of the tool body 12 and the wiring post 24 are parallel but displaced from each other. Assuming that the wire 22 was wrapped upon the post 24 in a clockwise direction as indicated by the arrow, the operator then rotates the tool 10 in the same direction. The inner body surface defined by the bore 20, as seen in phantom in its initial position, then pivots on successive corners, for example 24*a* and 24*b* of the wiring post 24, and as seen in dotted form in FIG. 4, the pigtail 22*a* is wiped down toward the surface of the post 24 and brought to within acceptable tolerances. It should be noted that the present tool 10** is bidirectional, in that it may be used without modification to correct defects in wires wrapped in either direction.

In providing substantial numbers of the tool described herein for use in a manufacturing environment, the tool body was formed from stainless steel sleeving having an outside diameter of 0.093 inches and an inside diameter of 0.043 inches. These dimensions result in a wall thickness of 0.025 inches. The cylindrical member was also conveniently formed of stainless steel sleeving having an outside diameter of 0.025 inches. A solid rod formed, for example, from music wire or a drill and having substantially like dimensions could also be substituted for the latter. The wiring post accommodated by a tool of the foregoing dimensions has a 0.025 inch square cross section, and the wire wrapped thereon is No. 30 gauge, which has a diameter of 0.010 inches. It should be understood that the foregoing dimensions have been provided solely for purposes of example and should not be construed as limitative of the invention.

In conclusion, there has been described a repair tool which has proved highly satisfactory in eliminating the rework normally entailed in correcting pigtails in wrapped wire connections. It is apparent that depending upon the particular application, changes and modifications of the tool as described herein may be required. For example, the dimensions of the tubular body are dependent upon the wire post dimensions and the wire gauge itself. Such changes and modifications, insofar as they are not departures from the true scope of the invention, are intended to be covered by the claims which follow.

What is claimed is:

1. A repair tool for correcting a pigtail formed in the last of a plurality of turns of wire wrapped upon a wiring post of rectangular cross section comprising:

an elongated tubular body having a bore of predetermined diameter for accommodating the maximum cross sectional dimension of said wiring post but not including the turns of wire wrapped thereon, a longitudinal slot formed in said body adjacent the forward extremity thereof, said slot extending from the outer surface of said body to said bore, a cylindrical member immovably affixed within said slot and providing a finger-like projection extending beyond said forward extremity, a portion of the surface of said cylindrical member being disposed on the periphery of said bore, whereby the disposition of said body over said wiring post causes said forward extremity to rest upon said plurality of turns of wire and said finger-like projection to contact the outer surface of said pigtail, the respective longitudinal center lines of said body and said wiring post being parallel but spaced apart from each other, whereupon the rotation of said body about its longitudinal axis causes the periphery of said bore to pivot on successive corners of said wiring post, thereby effecting the wiping down of said pigtail toward said wiring post by said finger-like projection.

2. A tool as defined in claim 1 further characterized in that the wall thickness of said body and the diameter of said cylindrical member are substantially the same.

3. A tool as defined in claim 2 further including a handle supporting said tubular body.

4. A tool as defined in claim 3 wherein said tubular body is formed of stainless steel sleeving.

* * * * *